US012065897B2

(12) United States Patent
Fripp et al.

(10) Patent No.: US 12,065,897 B2
(45) Date of Patent: Aug. 20, 2024

(54) PREVENTING OR REMOVING CONTAMINANTS IN WELLBORE FLUID USING AN ACOUSTIC ACTUATOR

(71) Applicant: Halliburton Energy Services, Inc., Houston, TX (US)

(72) Inventors: Michael Linley Fripp, Singapore (SG); Albert Winkler, Singapore (SG); Michael John Christie, Aberdeen (GB); Celso Max Trujillo, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 99 days.

(21) Appl. No.: 17/930,576

(22) Filed: Sep. 8, 2022

(65) Prior Publication Data

US 2024/0084659 A1 Mar. 14, 2024

(51) Int. Cl.

| | |
|---|---|
| ***E21B 31/00*** | (2006.01) |
| ***E21B 34/06*** | (2006.01) |
| ***E21B 36/02*** | (2006.01) |
| ***E21B 43/38*** | (2006.01) |

(52) U.S. Cl.

CPC ..... *E21B 31/005* (2013.01); *E21B 34/06* (2013.01); *E21B 36/02* (2013.01); *E21B 43/38* (2013.01)

(58) Field of Classification Search

CPC ..... E21B 31/005; E21B 34/06; E21B 36/02; E21B 43/38; E21B 28/00

See application file for complete search history.

(56) References Cited

U.S. PATENT DOCUMENTS

| | | | | |
|---|---|---|---|---|
| 5,568,448 | A * | 10/1996 | Tanigushi | E21B 41/0085 175/40 |
| 5,969,237 | A | 10/1999 | Jones et al. | |
| 6,880,402 | B1 | 4/2005 | Couet et al. | |
| 7,213,650 | B2 | 5/2007 | Lehman et al. | |
| 9,322,807 | B2 | 4/2016 | Lu et al. | |
| 2015/0138923 | A1 | 5/2015 | Abernathy et al. | |
| 2017/0211366 | A1 | 7/2017 | Xiao et al. | |
| 2018/0274339 | A1 * | 9/2018 | Wang | E21B 43/40 |
| 2021/0333238 | A1 | 10/2021 | Saeed et al. | |

FOREIGN PATENT DOCUMENTS

| | | | |
|---|---|---|---|
| CN | 210509119 | U | 5/2020 |
| CN | 215632899 | U | 1/2022 |
| EP | 2422040 | B1 | 4/2014 |
| WO | 2015062878 | A1 | 5/2015 |

OTHER PUBLICATIONS

International Patent Application No. PCT/US2022/076115, International Search Report and Written Opinion mailed Jun. 8, 2023, 10 pages.

* cited by examiner

*Primary Examiner* — Kristyn A Hall
(74) *Attorney, Agent, or Firm* — Kilpatrick Townsend & Stockton LLP

(57) ABSTRACT

An acoustic actuator for scale removal and prevention in a wellbore is described herein. For example, a system can include a tubing string deployed downhole in a wellbore. A downhole tool can be coupled to the tubing string. An acoustic actuator can be coupled to the tubing string and positioned proximate to the downhole tool. The acoustic actuator can generate an acoustic signal that can vibrate the tubing string to generate a fluidic disturbance in downhole fluid within the tubing string for removing contaminants from, or preventing formation of contaminants, on the downhole tool.

20 Claims, 6 Drawing Sheets

PREVENTING OR REMOVING CONTAMINANTS IN WELLBORE FLUID USING AN ACOUSTIC ACTUATOR

TECHNICAL FIELD

The present disclosure relates generally to wellbore operations and, more particularly (although not necessarily exclusively), to using an acoustic actuator to remove, prevent, or both contaminants such as scale in wellbore fluid.

BACKGROUND

A wellbore can be formed in a subterranean formation for extracting produced hydrocarbons or other suitable materials. Hydrocarbons and other fluids produced from, or injected into, the wellbore can include contaminants such as scale or asphaltenes. The contaminants may precipitate or settle into solid deposits. In some cases, the contaminants can accumulate on downhole tubing strings, which can restrict wellbore surveillance, restrict or prevent the flow of production fluid, limit downhole intervention, and interfere with and damage downhole tools. Chemical methods, such as chemical additives, for removing contaminants may pose health and safety risks to workers, damage production systems, and may not be effective.

DETAILED DESCRIPTION

Figure 1:
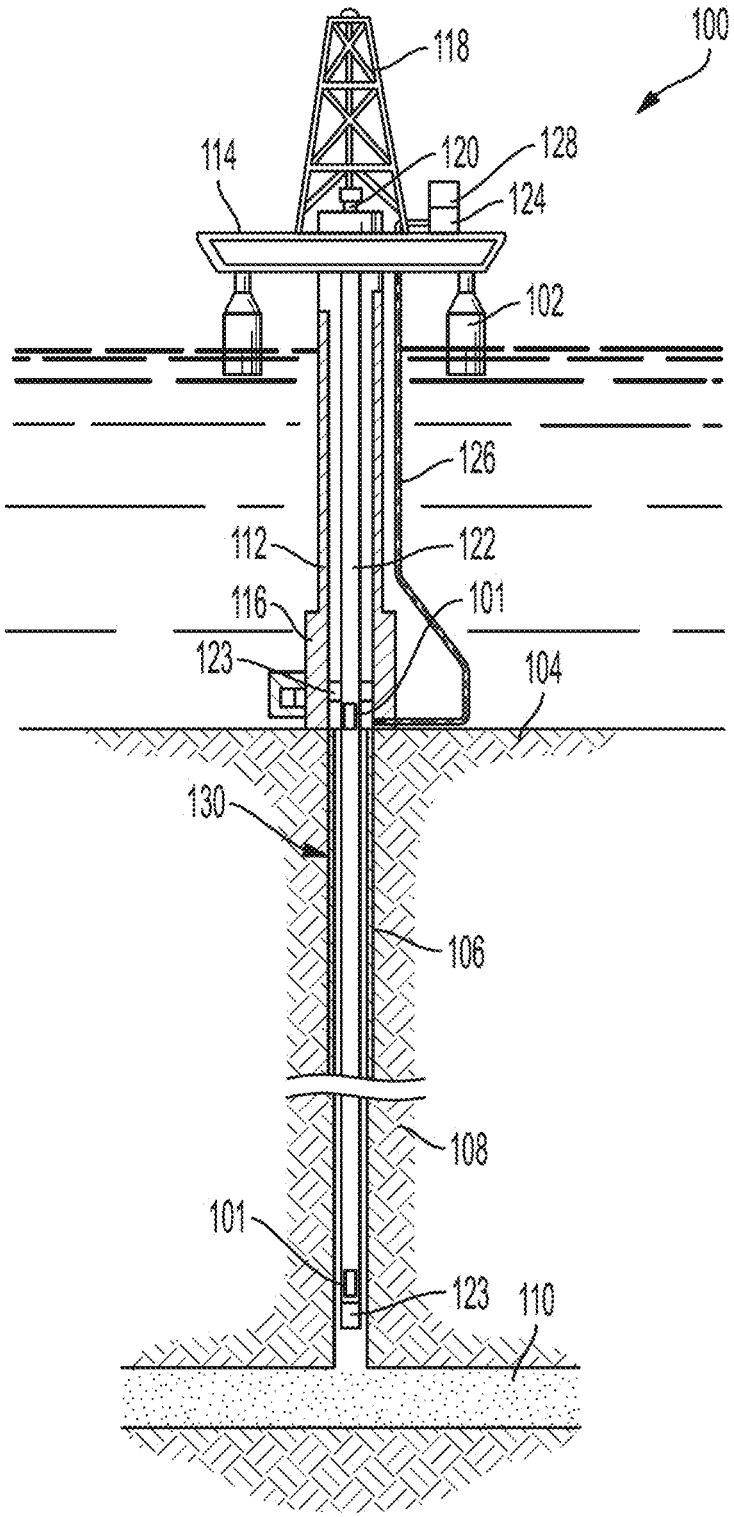
FIG. 1 is a cross-sectional view of an example of a wellbore environment including an acoustic actuator for contaminant removal and prevention according to some aspects of the present disclosure.

Certain aspects and examples of the present disclosure relate to removing or preventing the formation of scale on downhole tools in a wellbore by using an acoustic actuator to induce fluidic disturbances in downhole fluid within a tubing string. Contaminants, such as scale or asphaltene, can build up on tubing strings, and particularly on downhole tools coupled to tubing strings. An acoustic actuator can convert energy into acoustic signals at high frequencies. The acoustic actuator can be mounted on a tubing string near a downhole tool in a wellbore. By generating acoustic signals, the acoustic actuator can cause the tubing string to vibrate, which can affect downhole fluid flow within the tubing string. For example, vibration of the tubing string can induce cavitation or microstreaming. Microstreaming can cause micro-oscillations in the downhole fluid. The micro-oscillations can inhibit the formation of contaminants on the downhole tool by preventing contaminants from reaching the downhole tool. At higher energies, the acoustic actuator can induce cavitation. Cavitation can be caused by a pressure gradient formed by the vibration and can involve the formation of microscopic bubbles that can burst with relatively high intensity after contacting the downhole tool. The cavitation bubbles can clean the contaminants from the downhole tool when acoustic waves generated from the cavitation bubbles bursting have sufficient power to overcome the particle-to-substrate adhesion forces holding the contaminants to the downhole tool. The bursting of the cavitation bubbles can loosen and dislodge the contaminants.

The acoustic actuator can be used to perform contaminant removal without the use of dangerous or costly chemical treatments. Additionally, mounting the acoustic actuator near the downhole tool can provide more localized treatment than with conventional chemical treatments, as it can be difficult to supply appropriate quantities of chemical additives to specific locations downhole. In some examples, use of the acoustic actuator can be used in combination with chemical treatments. This can reduce the amount of chemical additives used downhole. Acoustic cavitation can also improve the effectiveness of hydrophobic chemical treatments. Hydrophobic chemicals can be attracted underwater by acoustic cavitation because the pressure differences between cavitation bubbles and liquid water can force hydrophobic chemicals to join together, concentrating the hydrophobic chemicals near the downhole tools. And by preventing or reducing formation of contaminants on downhole tools by using the acoustic actuator to induce microstreaming in downhole fluid in the tubing string, the need for contaminant removal can be reduced or eliminated.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a cross-sectional view of an example of a wellbore environment 100 including an acoustic actuator 101 for contaminant removal and prevention according to some aspects of the present disclosure. A floating workstation 102 (e.g., an oil platform or an offshore platform) can be centered over a submerged oil or gas well located in a sea floor 104 having a wellbore 106. The wellbore 106 may extend from the sea floor 104 through a subterranean formation 108. The subterranean formation 108 can include a fluid-bearing formation 110. A subsea conduit 112 can extend from the deck 114 of the floating workstation 102 into a wellhead installation 116. The floating workstation 102 can have a derrick 118 and a hoisting apparatus 120 for raising and lowering tools to drill, test, and complete the oil or gas well. The floating workstation 102 can be an oil platform as depicted in FIG. 1 or an aquatic vessel capable of performing the same or similar drilling and testing operations. In some examples, the process described herein can be applied to a land-based environment for wellbore exploration, planning, and drilling.

A tubing string 122 can be lowered into the wellbore 106 of the oil or gas well as part of a completion operation of the oil or gas well. Downhole fluids, such as production fluids, can flow through a flow path defined by the tubing string 122. The tubing string 122 can include one or more downhole tools 123 usable downhole. The downhole tools 123 can include wellbore stimulation equipment, production equipment, sand control tools, packers, retrievable tools, or flow control devices. Examples of flow control devices can include safety valves such as sub-surface safety valves and tubing retrieval sub-surface safety valves; flow valves including sleeves, inflow control valves, and barrier valves; flow restrictors including nozzles, inflow control valves, automatic inflow control devices, autonomous inflow control valves, ball valves, and flapper valves; and gas lift valves. In some examples, scale, asphaltenes, and other contaminants present in downhole fluids can adhere to the tubing string 122 and the downhole tools 123. One or more acoustic actuators 101 can be coupled to the tubing string 122 proximate the downhole tools 123. The acoustic actuator 101 can be positioned external to the flow path. For example, the acoustic actuator 101 can be coupled to an exterior of the tubing string 122. In other examples, the acoustic actuator 101 can be mounted within a wall of the tubing string 122, but external to the flow path. In some examples, multiple acoustic actuators 101 can be mounted circumferentially around the tubing string 122. Additionally or alternatively, the acoustic actuators 101 can be mounted axially along a length of the tubing string 122.

The acoustic actuator 101 can be used to remove contaminants deposited on the downhole tools 123, or to prevent the formation of contaminants on the downhole tools 123, by generating acoustic signals. The acoustic signals can cause the tubing string 122 to vibrate. The vibration of the tubing string 122 can cause fluidic disturbances in the downhole fluid. For example, the fluidic disturbances can include a pressure gradient of the downhole fluid caused by the acoustic signals. In some examples, the pressure gradient can include acoustic cavitation that can generate bubbles in the downhole fluid. The bubbles can burst on surfaces of the downhole tools 123 to dislodge contaminants, including scale and asphaltene. Additionally, the fluidic disturbances can include microstreaming that can generate oscillations within the downhole fluid. Microstreaming of downhole fluid can inhibit formation of contaminants on the downhole tools 123 by preventing contaminant particles within the downhole fluid from reaching the downhole tools 123. By positioning an acoustic actuator 101 proximate (e.g., within a single joint of tubing of) a downhole tool 123, the acoustic actuator 101 can be used to provide localized treatment and prevention of formation of contaminants on the downhole tool 123, rather than for use in acoustic communication by transmitting acoustic signals. For example, the acoustic actuator 101 may not include information encoded in its generated acoustic signals. The acoustic actuator 101 may direct acoustic energy inward (e.g., toward a center axis of the tubing string 122) rather than outward (e.g., away from the tubing string 122).

Figure 2:
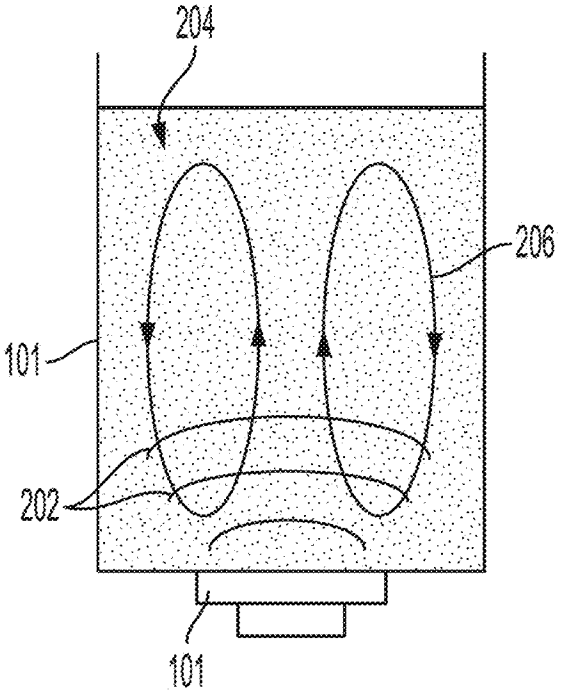
FIG. 2 is a diagram of an example of microstreaming in downhole fluid generated by an acoustic actuator according to some aspects of the present disclosure.

FIG. 2 is a diagram of an example of microstreaming 206 in downhole fluid 204 generated by an acoustic actuator 101 according to some aspects of the present disclosure. The acoustic actuator 101 can generate acoustic signals 202 directly in downhole fluid 204, or can generate acoustic signals 202 that can vibrate a tubing string 122 that includes downhole fluid 204. The acoustic signals 202 can induce the acoustic microstreaming 206 in the downhole fluid 204. Acoustic microstreaming 206 can occur close to the solid/liquid boundary of the downhole fluid 204. The acceleration forces from the movement of the microstreaming 206 can disrupt deposition of contaminants on nearby surfaces (such as downhole tools 123), transporting dislodged particles away in the fluid stream.

The acoustic signals 202 can induce the acoustic microstreaming 206 by homogenizing velocity vectors of sub-flows within the downhole fluid 204. Additionally, the acoustic signals 202 can decrease surface tension of the downhole fluid 204 near the solid/liquid boundary. The thickness of this boundary can vary with frequency of the acoustic signal 202 and with the medium of the downhole fluid 204. For water, the solid/liquid boundary can range from 8 microns with 2 MHz acoustic signals to 90 microns with 20 kHz acoustic signals. The microstreaming 206 can occur as a traveling wave, also known as Eckhart's streaming. Additionally or alternatively, microstreaming 206 can occur as a stationary wave. The microstreaming 206 may be more likely to be induced with acoustic signals 202 having relatively higher frequencies.

Figure 3:
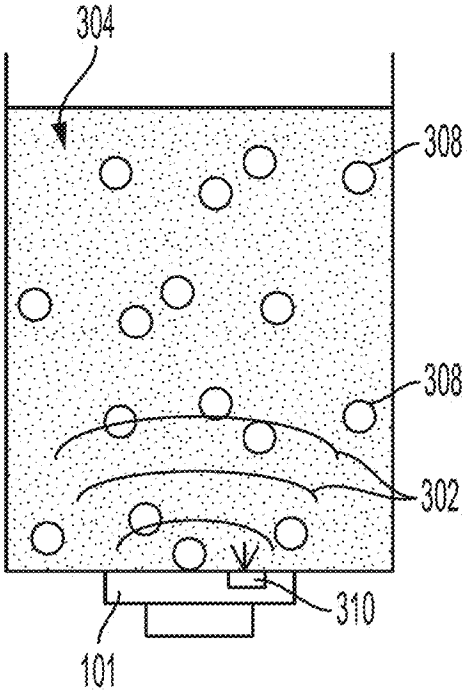
FIG. 3 is a diagram of an example of bubbles generated by an acoustic actuator according to some aspects of the present disclosure.

FIG. 3 is a diagram of an example of bubbles 308 generated by an acoustic actuator 101 according to some aspects of the present disclosure. The acoustic actuator 101 can generate acoustic signals 302 directly in downhole fluid 304, or can generate acoustic signals 302 that can vibrate a tubing string 122 that includes downhole fluid 304. The acoustic signals 302 can induce acoustic cavitation in the downhole fluid 304 to produce bubbles 308.

In some examples, the acoustic signals 302 can generate bubbles 308 in the downhole fluid 304 by reducing pressure in the downhole fluid 304 to create a pressure gradient. The reduction of pressure can cause water in the downhole fluid 304 to flash into bubbles of gaseous water vapor. This can be known as classical cavitation. The threshold pressure for the onset of classical cavitation can increase linearly with the hydrostatic pressure over a range from 1 bar to 300 bar. The pressure for the onset of cavitation at 300 bar is approximately sixteen times the onset pressure at 1 bar. Higher temperatures can reduce the onset pressure. At 200 bar, the onset pressure for cavitation of water at 35° C. can be 70% of the onset pressure at 18° C. But surface coatings of contaminants such as scale can be removed by the acoustic actuator 101 at pressure levels that are insufficient to cause full classical cavitation. Even below the classical cavitation threshold, acoustic waves in downhole fluid caused by the acoustic signals 302 can create pressure gradients that can contribute to surface cleaning through inducing a spall fracture in the surface of the contaminants.

In other examples, acoustic cavitation caused by the acoustic actuator 101 can generate the bubbles 308 by causing natural gas to come out of the downhole fluid 304. This can be known as evaporative cavitation. This may be more likely to occur than classical cavitation for more viscous downhole fluids, such as oil. In some examples, the acoustic actuator 101 can include a voltage generator 310 that can generate an electrical discharge (e.g., a spark) to cause acoustic cavitation by evaporating vapor gases in the downhole fluid 304. After bubbles 308 are formed, non-inertial cavitation can occur when the bubbles 308 in the downhole fluid 304 are forced to oscillate in the presence of an acoustic field generated by the acoustic actuator 101. These oscillations can occur at relatively low energy levels that are insufficient to cause total collapse of the bubbles 308. In some examples, non-inertial cavitation can cause less contaminant erosion than inertial cavitation. Although non-inertial cavitation can occur in bubbles 308 formed through classical cavitation, it is more likely to occur in bubbles 308 caused by evaporating gases.

Figure 4:
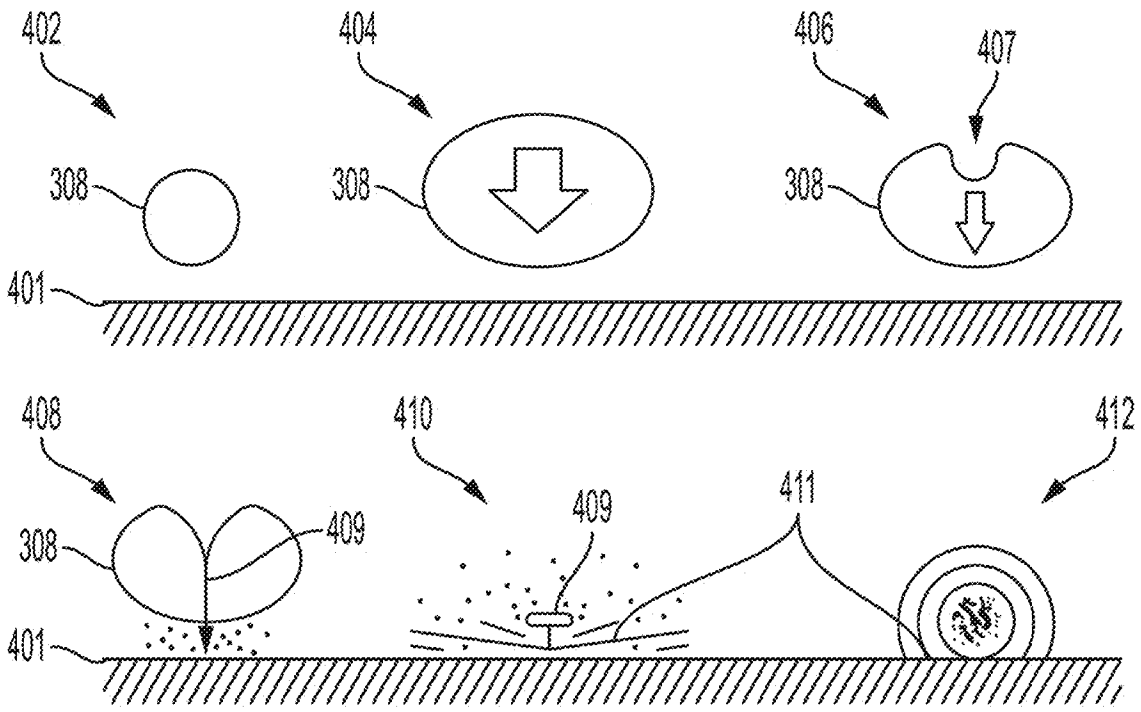
FIG. 4 is a diagram of an example of acoustic cavitation bubbles generated by an acoustic actuator according to some aspects of the present disclosure.

FIG. 4 is a diagram of an example of acoustic cavitation bubbles 308 generated by an acoustic actuator 101 according to some aspects of the present disclosure. At stage 402, a bubble 308 can be formed through acoustic cavitation near a fouling surface 401, such as the downhole tool 123 of FIG. 1. The acoustic cavitation may cause vapor gases to evaporate into the bubble 308 within surrounding fluid. At stage 404, the bubble 308 can move away from the energy that formed the bubble 308, such as toward the fouling surface 401. For example, the bubble 308 may move downstream, or the acoustic signal causing the acoustic cavitation may cease. At stage 406, the bubble 308 may collapse due to its higher pressure when the energy that formed the bubble 308 is no longer present. For example, region 407 of the bubble 308 may begin to collapse inward.

At stage 408, region 407 can collapse into a micro-jet 409 as inward inertia of the surrounding fluid can cause a sharp increase of pressure. At stage 410, the bubble 308 can burst onto the fouling surface 401 as the bubble 308 collapses into a minute fraction of its original size. The micro-jet 409 can contact contaminants 411 such as scale on the fouling surface 401. At stage 412, the bubble 308 bursting can release a significant amount of energy per volume concentrated as an acoustic shock wave. The acoustic shock wave can be several hundred atmospheres above the hydrostatic pressure. The acoustic shock wave may dislodge further contaminants 411 from the fouling surface 401.

Referring again to FIG. 1, the acoustic actuator 101 can generate acoustic signals with excitation frequencies between 1 kHz and 10 MHz. For example, the excitation frequencies can be between 1 kHz and 500 kHz, between 500 kHz and 1 MHz, between 1 MHz and 2 MHz, between 2 MHz and 3 MHz, between 3 MHz and 4 MHz, between 4 MHz and 5 MHz, between 5 MHz and 6 MHz, between 6 MHz and 7 MHz, between 7 MHz and 8 MHz, between 8 MHz and 9 MHz, or between 9 MHz and 10 MHz. The excitation power of the acoustic actuator 101 can be between 0.1 W and 1,000 W. For example, the excitation power can be between 0.1 W and 0.5 W, between 0.5 W and 1 W, between 1 W and 10 W, between 10 W and 20 W, between 20 W and 30 W, between 30 W and 40 W, between 40 W and 50 W, between 50 W and 60 W, between 60 W and 70 W, between 70 W and 80 W, between 80 W and 90 W, between 90 W and 100 W, between 100 W and 200 W, between 200 W and 300 W, between 300 W and 400 W, between 400 W and 500 W, between 500 W and 600 W, between 600 W and 700 W, between 700 W and 800 W, between 800 W and 900 W, or between 900 W and 1000 W. Increasing the excitation power can increase rate of removal of the contaminants from the downhole tool 123. The rate of removal may decrease as thickness of the contaminants on the downhole tool 123 increases, as the contaminants can act as an acoustic damper. Thus, routine periodic cleaning may be beneficial.

The acoustic actuator 101 can be calibrated before use by testing a range of excitation frequencies. An optimal frequency that sends the most effective soundwaves along a length of the tubing string 122 can be determined. Electrical impedance of the tubing string 122 can vary with frequency. The optimal frequency may have a phase angle of 0° and a relatively low (e.g., lower than the resonant frequency of the electrical circuit within the acoustic actuator 101) electrical energy consumption, which may be more energy efficient. The 0° phase can be used to track any changes to the optimal frequency. The phase tracking can be set to 0° or to a phase that is slightly lower or higher depending on the electrical efficiency of the electrical circuit within the acoustic actuator 101.

In some examples, the acoustic signal generated by the acoustic actuator 101 can have a vibration amplitude between 0.1 microns and 100 microns. For example, the vibration amplitude may be from 0.1 microns to 0.5 microns, from 0.5 microns to 1 micron, from 1 micron to 5 microns, from 5 microns to 10 microns, from 10 microns to 15 microns, from 15 microns to 20 microns, from 20 microns to 25 microns, from 25 microns to 30 microns, from 30 microns to 35 microns, from 35 microns to 40 microns, from 40 microns to 45 microns, from 45 microns to 50 microns, from 50 microns to 55 microns, from 55 microns to 60 microns, from 60 microns to 65 microns, from 65 microns to 70 microns, from 70 microns to 75 microns, from 75 microns to 80 microns, from 80 microns to 85 microns, from 85 microns to 90 microns, from 90 microns to 95 microns, or from 95 microns to 100 microns.

When multiple acoustic actuators 101 are arranged about the tubing string 122, such as along the axial length or in circumference, the acoustic actuators 101 may not be in phase. In some examples, different phase delays between the acoustic actuators 101 can trigger different flexural modes in the tubing string 122. This phased array of acoustic actuators 101 can focus acoustic energy to specific locations within the tubing string 122, such as to specific downhole tools 123. The excitation can use continuous waves or micro-pulses. For example, up to 100 micro-pulses can be transmitted per second.

Excitation of acoustic actuators 101 for contaminant prevention and removal can differ from the use of acoustic actuators 101 as fluid flow meters. For example, acoustic fluid flow meters may minimize vibration in the tubing string 122 and may maximize vibration directed into downhole fluid within the tubing string 122, as vibration in the tubing string 122 can confound measurements of the downhole fluid. In contrast, acoustic actuators 101 used for contaminant prevention and removal can be used to maximize vibration in the tubing string 122 rather than the downhole fluid. Additionally, such acoustic actuators 101 can operate at higher powers and lower frequencies than acoustic fluid flow meters, which tend to be lower power and relatively higher frequencies. For example, acoustic fluid flow meters may operate at or below 1 W of power and up to MHz frequencies. Acoustic actuators 101 can perform contaminant prevention and removal at 10 W of power or higher, and frequencies that may be less than 30 kHz.

In some examples, the acoustic actuator 101 can be powered via a downhole generator. In other examples, the acoustic actuator 101 can be electrically powered. An electrical power source 124 (e.g., an electrical power generator) located on the deck 114 can provide power along an electrical conductor 126 to provide electrical power to the acoustic actuator 101. In some examples, other control lines (not shown) may also be provided within or alongside the electrical conductor 126 to provide control signals from a controller 128 to the acoustic actuator 101. In other examples, a telemetry communication system may enable transmission of the control signals wirelessly from the controller 128 to the acoustic actuator 101. Additionally or alternatively, the acoustic actuator 101 can be flow-powered via the downhole fluid as a mechanical acoustic actuator without electrical circuitry. Examples of flow-powered acoustic actuators can include rotating mechanical acoustic actuators such as a rotating siren or a rotating hammer striking a bell or lamellae (like a music box), as well as non-rotating mechanical acoustic actuators such as a flow-powered bell-and-clapper, vortex-shedding, and a whistle.

Figure 5:
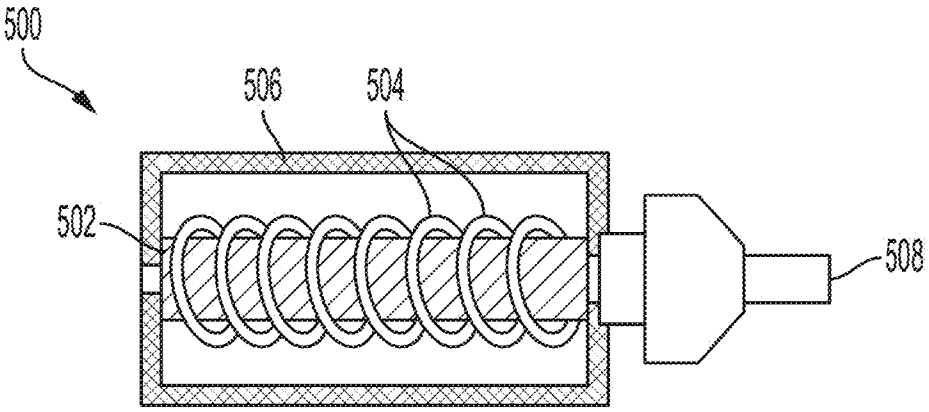
FIG. 5 is a diagram of an example of an acoustic actuator for contaminant removal and prevention downhole according to some aspects of the present disclosure.

FIG. 5 is a diagram of an example of an acoustic actuator 500 for contaminant removal and prevention downhole according to some aspects of the present disclosure. The acoustic actuator 500 can be a magnetostrictive transducer that can induce a magentostrictive excitation of the tubing string 122. The acoustic actuator 500 includes a ferromagnetic core 502 around which winding coils 504 are wound within a casing 506. An electric current can be passed through the winding coils 504 to induce a magnetic field. The magnetic field can cause contraction and expansion of the ferromagnetic core 502, which can generate an acoustic signal. The acoustic signal can be emitted through an emitting surface 508. In some examples, the acoustic actuator 500 may be mounted on an exterior of the tubing string 122, with the emitting surface 508 contacting the exterior of the tubing string 122. In other examples, the acoustic actuator 500 may be mounted within a wall of the tubing string 122, and the emitting surface 508 may contact at least one of the wall of the tubing string 122 or downhole fluid within the tubing string 122. In some examples, the acoustic actuator 500 may directly actuate the tubing string 122. For example, the ferromagnetic core 502 and the winding coils 504 may be wound about a circumference of the tubing string 122, and a generated acoustic signal may be transmitted directly onto the tubing string 122.

Figure 6:
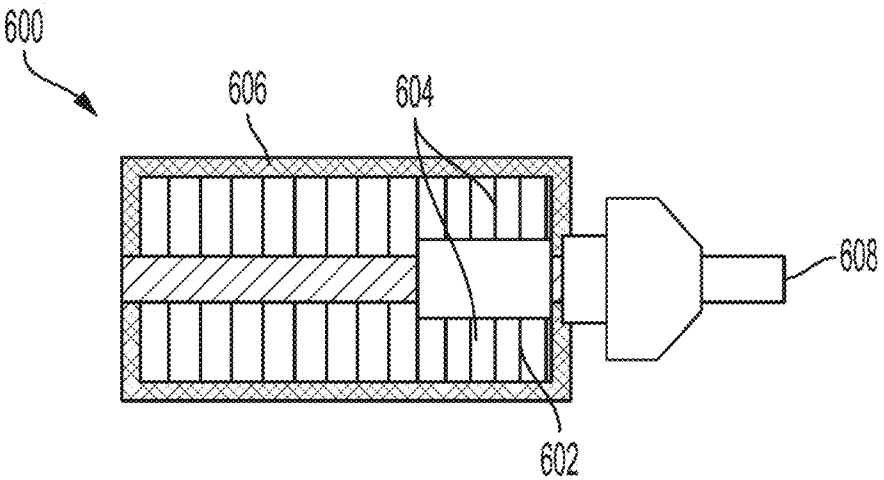
FIG. 6 is a diagram of another example of an acoustic actuator for contaminant removal and prevention downhole according to some aspects of the present disclosure.

FIG. 6 is a diagram of another example of an acoustic actuator 600 for contaminant removal and prevention downhole according to some aspects of the present disclosure. The acoustic actuator 600 can be a Langevin transducer that can create flexural vibration in a tubing string 122. The acoustic actuator 600 includes piezoelectric wafers 602 sandwiched between metal electrodes 604 within a casing 606. An electric current can be generated by the metal electrodes 604 to excite the piezoelectric wafers 602. The excitation of the piezoelectric wafers 602 can generate an acoustic signal that is emitted at an emitting surface 608. In some examples, the acoustic actuator 600 may be mounted on an exterior of the tubing string 122, with the emitting surface 608 contacting the exterior of the tubing string 122. In other examples, the acoustic actuator 600 may be mounted within a wall of the tubing string 122, and the emitting surface 608 may contact at least one of the wall of the tubing string 122 or downhole fluid within the tubing string 122.

Figure 7:
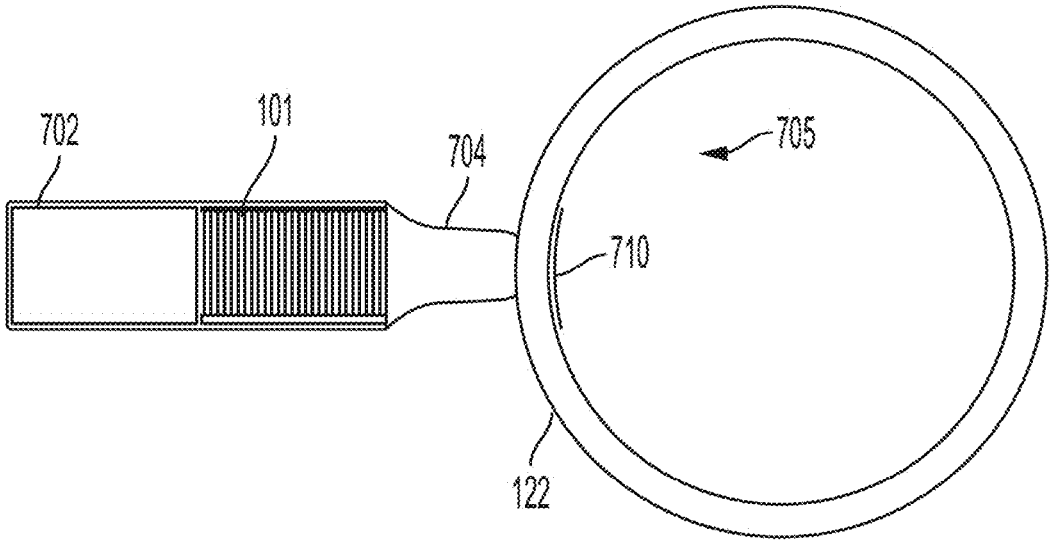
FIG. 7 is a top view of an example of an acoustic actuator with a compressive load and an actuator horn according to some aspects of the present disclosure.

FIG. 7 is a top view of an example of an acoustic actuator 101 with a compressive load 702 and an acoustic horn 704 according to some aspects of the present disclosure. The acoustic actuator 101 is coupled to the acoustic horn 704, which in turn is coupled to a tubing string 122. An interior of the tubing string 122 can define a flow path 705 through which downhole fluid may flow. A compressive load 702 is coupled to the acoustic actuator 101. The acoustic horn 704, also known as a sonotrode, an acoustic waveguide, or an ultrasonic probe, can concentrate and amplify an acoustic signal generated by the acoustic actuator 101. In some examples, the acoustic horn 704 can have a concave surface that can improve energy transfer of the acoustic signal into the tubing string 122.

The compressive load 702 can be a reaction mass that can compress the acoustic actuator 101 against the tubing string 122. Compression of the acoustic actuator 101 can additionally amplify the acoustic signal generated by the acoustic actuator 101. In some examples, as depicted in FIG. 7, the compressive load 702 can be a mass coupled to an end of the acoustic actuator 101 opposite the tubing string 122 or acoustic horn 704. In other examples, the compressive load 702 can be a central bolt running through the acoustic actuator 101. In some examples, such as the one depicted in FIG. 8, the compressive load 702 can be a compressive housing 808. The compressive housing 808 can be cylindrical and can house and compress the acoustic actuator 101 against the tubing string 122.

Figure 8:
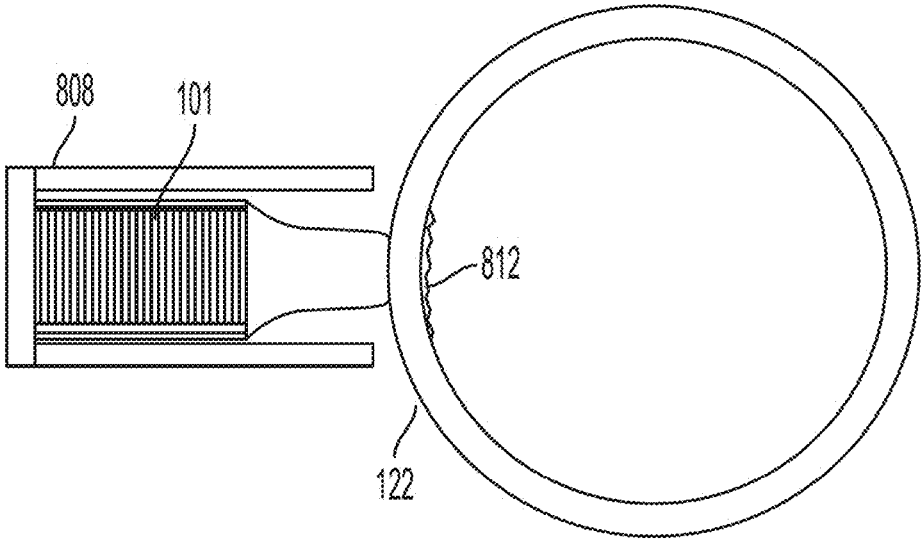
FIG. 8 is a top view of an example of an acoustic actuator with a compressive housing and an actuator horn according to some aspects of the present disclosure.

In some examples, the tubing string 122 can include surface treatments that can increase formation of cavitation bubbles. For example, referring again to FIG. 7, an interior surface of the tubing string 122 near the acoustic actuator 101 can be treated with a hydrophobic coating 710 such as polytetrafluoroethylene. The hydrophobic coating 710 can increase stabilization of relatively small bubbles within the downhole fluid. This can aid in the formation of cavitation bubbles at lower pressures. In another example, as depicted in FIG. 8, an interior surface of the tubing string 122 near the acoustic actuator 101 can include microgrooves 812 that can increase a roughness of the interior surface. The microgrooves 812 can aid in the formation of cavitation bubbles, as cavitation bubbles tend to be generated on nucleation surfaces. Nucleation surfaces can include impurities in fluid or on sides of containers, such as the increased roughness caused by the microgrooves 812.

Figure 9:
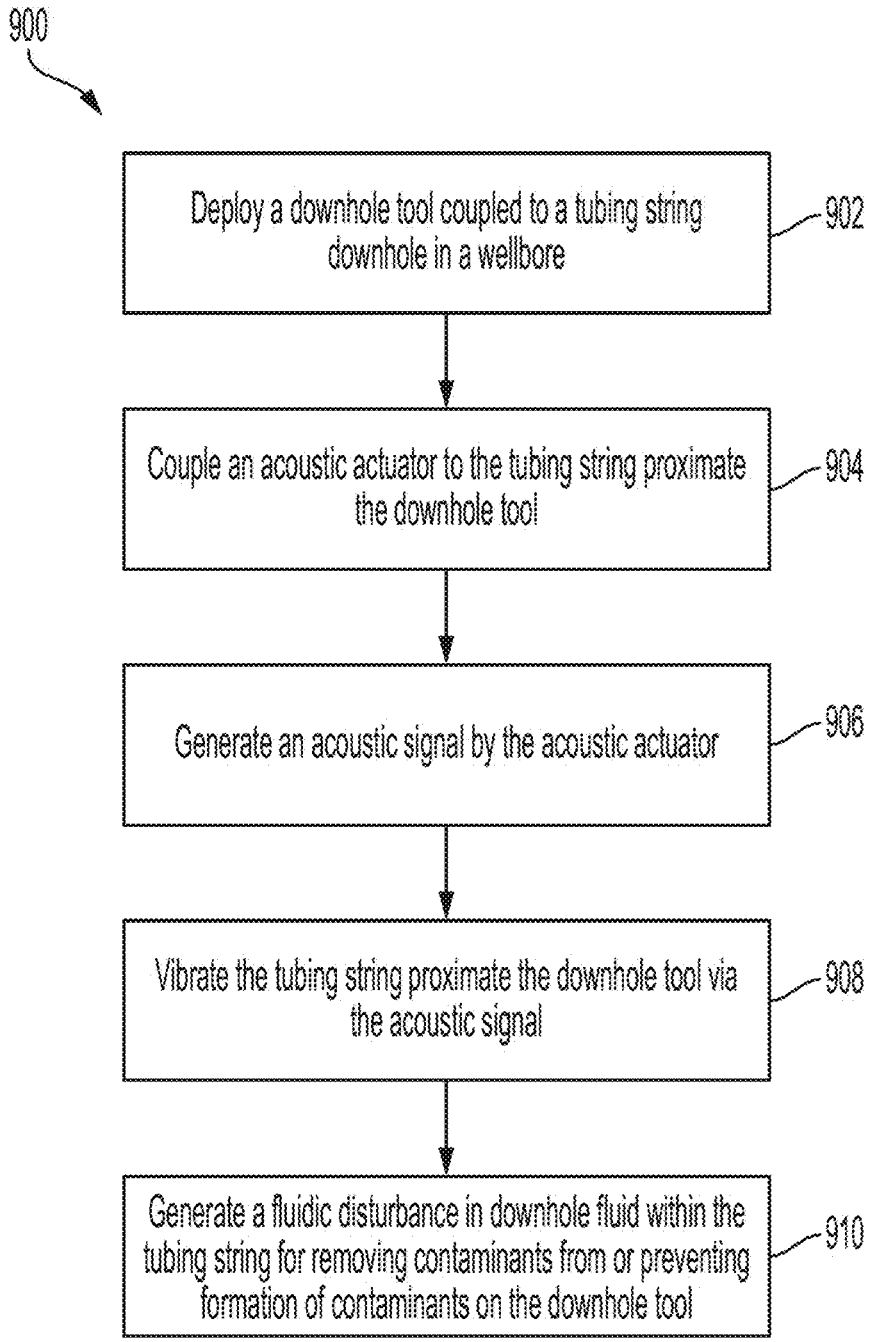
FIG. 9 is a flowchart of an example of a process for using an acoustic actuator for contaminant removal and prevention downhole according to some aspects of the present disclosure.

FIG. 9 is a flowchart of an example of a process 900 for using an acoustic actuator 101 for contaminant removal and prevention downhole according to some aspects of the present disclosure. The steps and components of FIG. 9 are described with respect to the components of FIGS. 1-8.

At block 902, the process 900 involves deploying a downhole tool 123 coupled to a tubing string 122 downhole in a wellbore 106. In some examples, the downhole tool 123 can be a safety valve, a flow controller, or a retrievable tool. Scale, asphaltene, and other contaminants from downhole fluid 204 within the tubing string 122 may deposit onto the downhole tool 123. Contaminants deposited onto moving parts of the downhole tool 123 may prevent the downhole tool 123 from functioning. In some examples, an inner surface of the tubing string 122 proximate the downhole tool 123 can be treated with a surface treatment such as a hydrophobic coating 710 or microgrooves 812.

At block 904, the process 900 involves coupling an acoustic actuator 101 to the tubing string 122 proximate the downhole tool 123. The acoustic actuator 101 may be coupled to the tubing string 122 before or after the tubing string 122 is deployed downhole. In some examples, a single acoustic actuator 101 can be coupled to the tubing string 122 near the downhole tool 123. In other examples, multiple acoustic actuators 101 can be coupled to the tubing string 122 near the downhole tool 123. For example, the acoustic actuators 101 can be coupled about a circumference of the tubing string 122. Additionally or alternatively, the acoustic actuators 101 can be coupled about an axial length of the tubing string 122. The acoustic actuator 101 may be positioned on an exterior of the tubing string 122, or within a wall of the tubing string 122. Thus, the acoustic actuator 101 may be positioned external to a flow path 705 defined by an interior surface of the tubing string 122.

At block 906, the process 900 involves generating an acoustic signal 202 by the acoustic actuator 101. For example, the acoustic actuator 101 may generate an acoustic signal 202 with a vibration amplitude between 5 and 100 microns. The acoustic signal 202 may be amplified by an acoustic horn 704 positioned between the acoustic actuator 101 and the tubing string 122. Additionally or alternatively, the acoustic signal 202 may be amplified by a compressive load 702 compressing the acoustic actuator 101 against the tubing string 122. In some examples, the compressive load 702 may be a compressive housing 808 positioned around the acoustic actuator 101. The acoustic actuator 101 may emit the acoustic signal 202 onto the tubing string 122.

At block 908, the process 900 involves vibrating the tubing string 122 proximate the downhole tool 123 via the acoustic signal 202. The vibration of the tubing string 122 can affect downhole fluid within the tubing string 122. For example, at block 910, the process 900 involves generating a fluidic disturbance in downhole fluid 204 within the tubing string 122 for removing contaminants from, or preventing formation of contaminants, on the downhole tool 123. For example, to prevent formation of contaminants on the downhole tool 123, the fluidic disturbance can include acoustic microstreaming 206 of the downhole fluid 204 caused by the vibration of the tubing string 122. The acoustic microstreaming 206 can move contaminant particles away from the downhole tool 123 to prevent the contaminant particles from adhering to the downhole tool 123. Additionally or alternatively, the fluidic disturbance can be bubbles 208 generated from acoustic cavitation caused by the vibration of the tubing string 122. The bubbles 208 may burst with high intensity onto the downhole tool 123, dislodging or loosening contaminants on the downhole tool 123.

In some aspects, system and method for using an acoustic actuator for contaminant removal and prevention downhole in a wellbore are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a system comprising: a tubing string deployable downhole in a wellbore; a downhole tool coupled to the tubing string; and an acoustic actuator coupled to the tubing string and positionable proximate to the downhole tool to generate an acoustic signal to vibrate the tubing string to generate a fluidic disturbance in downhole fluid within the tubing string for removing contaminants from, or preventing formation of contaminants, on the downhole tool.

Example 2 is the system of example(s) 1, wherein the acoustic actuator is configurable to generate the acoustic signal to vibrate the tubing string to cause acoustic microstreaming of the downhole fluid in the tubing string to prevent formation of contaminants on the downhole tool.

Example 3 is the system of example(s) 1-2, wherein the acoustic actuator is configurable to generate the acoustic signal to vibrate the tubing string to cause a pressure gradient of the downhole fluid in the tubing string to generate a plurality of bubbles to remove contaminants from the downhole tool.

Example 4 is the system of example(s) 1-3, wherein the acoustic actuator further comprises a voltage generator that is configurable to generate a spark in the downhole fluid to cause the pressure gradient of the downhole fluid.

Example 5 is the system of example(s) 1-4, wherein the acoustic actuator is positionable external to a flow path defined by an interior surface of the tubing string.

Example 6 is the system of example(s) 1-5, wherein the system further comprises an acoustic horn positionable between the acoustic actuator and the tubing string, the acoustic horn being configurable to amplify the acoustic signal.

Example 7 is the system of example(s) 1-6, wherein the system further comprises a compressive load configurable to compress the acoustic actuator against the tubing string to amplify the acoustic signal.

Example 8 is the system of example(s) 1-7, wherein the compressive load is a cylindrical housing positionable around the acoustic actuator.

Example 9 is the system of example(s) 1-8, wherein an inner surface of the tubing string comprises a surface treatment comprising at least one of a hydrophobic coating or microgrooves.

Example 10 is the system of example(s) 1-9, wherein the downhole tool comprises at least one of a safety valve, a flow controller, or a retrievable tool.

Example 11 is a method comprising: deploying a downhole tool coupled to a tubing string downhole in a wellbore; coupling an acoustic actuator to the tubing string proximate the downhole tool; and generating, by the acoustic actuator, an acoustic signal to: vibrate the tubing string proximate the downhole tool via the acoustic signal; and generate a fluidic disturbance in downhole fluid within the tubing string for removing contaminants from, or preventing formation of contaminants, on the downhole tool in response to vibrating the tubing string.

Example 12 is the method of example(s) 11, wherein generating the fluidic disturbance further comprises: causing acoustic microstreaming of the downhole fluid in the tubing string to prevent formation of contaminants on the downhole tool in response to vibrating the tubing string.

Example 13 is the method of example(s) 11-12, wherein generating the fluidic disturbance further comprises: causing a pressure gradient of the downhole fluid in the tubing string to generate a plurality of bubbles to remove contaminants from the downhole tool in response to vibrating the tubing string.

Example 14 is the method of example(s) 11-13, wherein causing the pressure gradient of the downhole fluid further comprises: generating, by a voltage generator in the acoustic actuator, a spark in the downhole fluid.

Example 15 is the method of example(s) 11-14, wherein coupling the acoustic actuator to the tubing string comprises: positioning the acoustic actuator external to a flow path defined by an interior surface of the tubing string.

Example 16 is the method of example(s) 11-15, wherein the method further comprises: amplifying the acoustic signal by an acoustic horn positioned between the acoustic actuator and the tubing string.

Example 17 is the method of example(s) 11-16, wherein the method further comprises: compressing, by a compressive load, the acoustic actuator against the tubing string to amplify the acoustic signal.

Example 18 is the method of example(s) 11-17, wherein the compressive load is a cylindrical housing positioned around the acoustic actuator.

Example 19 is the method of example(s) 11-18, wherein the method further comprises: treating an inner surface of the tubing string with a surface treatment, the surface treatment comprising at least one of a hydrophobic coating or microgrooves.

Example 20 is the method of example(s) 11-19, wherein the downhole tool comprises at least one of a safety valve, a flow controller, or a retrievable tool.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a tubing string deployable downhole in a wellbore;

a downhole tool coupled to the tubing string; and an acoustic actuator coupled to the tubing string and positionable proximate to the downhole tool to generate an acoustic signal to vibrate the tubing string to cause acoustic microstreaming of downhole fluid within the tubing string for preventing formation of contaminants on the downhole tool by transporting contaminants away from the downhole tool with micro-oscillations generated by the acoustic microstreaming.

2. The system of claim 1, wherein the acoustic actuator is configurable to generate the acoustic signal to vibrate the tubing string to cause a pressure gradient of the downhole fluid in the tubing string to generate a plurality of bubbles to remove contaminants from the downhole tool.

3. The system of claim 2, wherein the acoustic actuator further comprises a voltage generator that is configurable to generate a spark in the downhole fluid to cause the pressure gradient of the downhole fluid.

4. The system of claim 1, wherein the acoustic actuator is positionable external to a flow path defined by an interior surface of the tubing string.

5. The system of claim 1, wherein the system further comprises an acoustic horn positionable between the acoustic actuator and the tubing string, the acoustic horn being configurable to amplify the acoustic signal.

6. The system of claim 1, wherein the system further comprises a compressive load configurable to compress the acoustic actuator against the tubing string to amplify the acoustic signal.

7. The system of claim 6, wherein the compressive load is a cylindrical housing positionable around the acoustic actuator.

8. The system of claim 1, wherein an inner surface of the tubing string comprises a surface treatment comprising at least one of a hydrophobic coating or microgrooves.

9. The system of claim 1, wherein the downhole tool comprises at least one of a safety valve, a flow controller, or a retrievable tool.

10. A method comprising:

deploying a downhole tool coupled to a tubing string downhole in a wellbore;

coupling an acoustic actuator to the tubing string proximate the downhole tool; and generating, by the acoustic actuator, an acoustic signal to:

vibrate the tubing string proximate the downhole tool via the acoustic signal;

generate a fluidic disturbance in downhole fluid within the tubing string for preventing formation of contaminants on the downhole tool in response to vibrating the tubing string, wherein the fluidic disturbance comprises an acoustic microstreaming of the downhole fluid; and transport, by micro-oscillations in the downhole fluid generated by the acoustic microstreaming, the contaminants away from the downhole tool.

11. The method of claim 10, wherein generating the fluidic disturbance further comprises:

causing a pressure gradient of the downhole fluid in the tubing string to generate a plurality of bubbles to remove contaminants from the downhole tool in response to vibrating the tubing string.

12. The method of claim 11, wherein causing the pressure gradient of the downhole fluid further comprises:

generating, by a voltage generator in the acoustic actuator, a spark in the downhole fluid.

13. The method of claim 10, wherein coupling the acoustic actuator to the tubing string comprises:

positioning the acoustic actuator external to a flow path defined by an interior surface of the tubing string.

14. The method of claim 10, wherein the method further comprises:

amplifying the acoustic signal by an acoustic horn positioned between the acoustic actuator and the tubing string.

15. The method of claim 10, wherein the method further comprises:

compressing, by a compressive load, the acoustic actuator against the tubing string to amplify the acoustic signal.

16. The method of claim 15, wherein the compressive load is a cylindrical housing positioned around the acoustic actuator.

17. The method of claim 10, wherein the method further comprises:

treating an inner surface of the tubing string with a surface treatment, the surface treatment comprising at least one of a hydrophobic coating or microgrooves.

18. The method of claim 10, wherein the downhole tool comprises at least one of a safety valve, a flow controller, or a retrievable tool.

19. The method of claim 10, wherein generating the fluidic disturbance in the downhole fluid further comprises decreasing, via the acoustic signal, a surface tension of the downhole fluid in the tubing string.

20. The method of claim 10, wherein generating the fluidic disturbance in the downhole fluid further comprises homogenizing, via the acoustic signal, one or more velocity vectors of one or more sub-flows within the downhole fluid.

* * * * *